United States Patent [19]

Mosser et al.

[11] Patent Number: 4,662,546

[45] Date of Patent: May 5, 1987

[54] SUBMERGED NOZZLE FOR USE IN THE CONTINUOUS CASTING OF SLABS

[75] Inventors: John E. Mosser, Sarver; Daniel R. Flaherty, Pittsburgh; James R. Riedl, Freeport, all of Pa.

[73] Assignee: Allegheny Ludlum Corporation, Pittsburgh, Pa.

[21] Appl. No.: 760,446

[22] Filed: Jul. 30, 1985

[51] Int. Cl.[4] ..... B65D 5/72

[52] U.S. Cl. ..... 222/591; 222/566; 164/437; 239/559

[58] Field of Search ..... 164/437, 439, 440, 489, 164/490; 222/566, 565, 591; 239/558, 559

[56] References Cited

U.S. PATENT DOCUMENTS

| | | | |
|---|---|---|---|
| 3,322,347 | 5/1967 | Pierce | 239/559 |
| 3,517,726 | 6/1970 | Mills et al. | 164/82 |
| 3,578,064 | 5/1971 | Mills | 164/437 |
| 3,951,317 | 4/1976 | Hosokawa et al. | 164/437 |

*Primary Examiner*—Joseph J. Rolla
*Assistant Examiner*—Kenneth Noland
*Attorney, Agent, or Firm*—Patrick J. Viccaro

[57] ABSTRACT

A submerged nozzle for use in introducing molten metal below the surface of a molten metal pool in a flow-through continuous casting mold. The nozzle is tubular and has an upper end connected to a source of molten metal to be introduced to the mold for casting. The lower end of the nozzle is closed and adjacent this end are two molten metal outlet ports of equal diameter and in opposed relation with each being axially inclined upwardly at an angle of about 15°. Four additional equal diameter molten metal outlet ports with a diameter of each being larger than the diameter of the said two molten metal outlet ports are positioned adjacent said lower end of the nozzle in diametrically opposed pairs with each pair being nonradial at an included angle of 30° and inclined upwardly at an angle of about 15°.

9 Claims, 6 Drawing Figures

FIG. 1
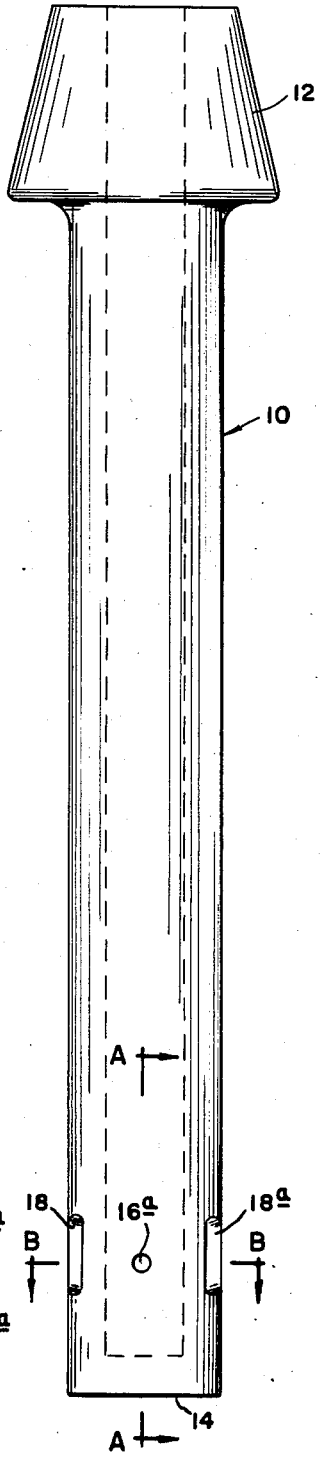
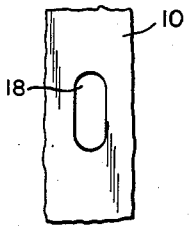
FIG. 5
FIG. 3
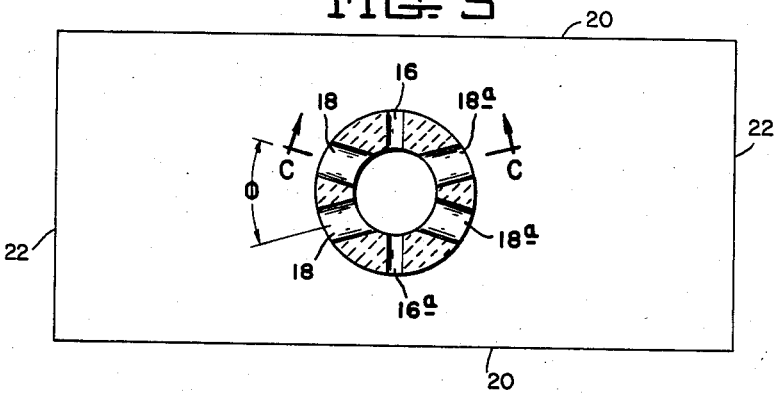
FIG. 6
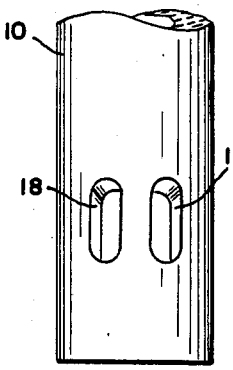
FIG. 4
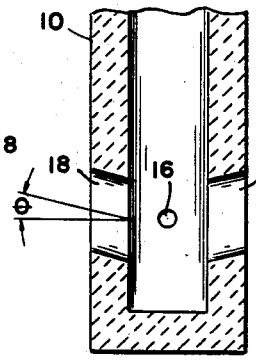
FIG. 2
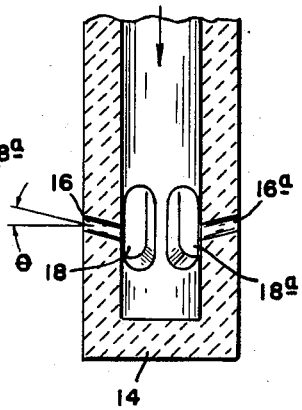

SUBMERGED NOZZLE FOR USE IN THE CONTINUOUS CASTING OF SLABS

BACKGROUND OF THE INVENTION

The continuous casting of slabs, and particularly stainless steel slabs, is typically accomplished by using a flow-through continuous casting mold having a rectangular internal mold cavity. A submerged nozzle is used for introducing molten metal below the surface of a molten metal pool which is formed in the continuous casting mold. For this purpose, bifurcated submerged nozzles are used; however, these cause problems in the casting operation, particularly in the casting of stainless steel slabs.

Specifically, in the production of stainless steels it is common to add titanium for stabilization purposes. The titanium is added in the tap ladle prior to the continuous casting operation. A portion of the titanium reacts with the nitrogen dissolved in the metal to form small, insoluble nitride particles in the molten metal introduced to the continuous casting mold. These nitride particles tend to coalesce and collect in the continuous casting mold by floating on the surface of the molten metal in the mold or accumulating as entrapped particles in the solidified metal portion of the continuous casting. These nitrides result in objectionable titanium streaks on the surface of the hot-rolled band produced from the continuously cast slab. This may be sufficiently severe to cause rejection and ultimate scrapping of the metal.

Another problem encountered with conventional submerged nozzles occurs during the initial filling of the continuous casting mold with molten metal during startup. During this operation, a considerable quantity of the metal introduced to the mold is initially splashed onto the mold walls. This splashed metal solidifies on the mold walls and becomes oxidized before the molten metal level rises to cover and melt them. This may result in poor surface quality of the initial portion of the slab casting, which ultimately results in surface defects, such as laps and seams, on the hot-rolled band produced from this initial portion of the casting. To prevent this, the mold is initially lined with a metal liner, termed "splash cans" which is designed to prevent metal splashing onto the mold wall surfaces until the metal level in the mold covers the nozzle ports. Thereafter, the splash can melts into the molten metal pool within the mold. Often, however, the splash can melts or otherwise disintegrates before the nozzle ports are covered and thus does not satisfactorily perform its intended function.

Attempts have been made by others, such as shown in U.S. Pat. Nos. 3,517,726, issued June 30, 1970, and 3,578,064, issued May 11, 1971, to use multiport submerged nozzles for continuous casting of slabs. Those patents do not teach or suggest the nozzle of the present invention.

SUMMARY OF THE INVENTION

It is accordingly a primary object of the present invention to provide a submerged nozzle that avoids the problem of nitride inclusions and splashing on the mold walls and can be used in the continuous casting of a variety of alloy grades, including austenitic or ferritic grades of stainless steel.

A more specific object of the invention is to provide a submerged nozzle for continuous casting operations that may be used in the casting of austenitic or ferritic grades of stainless steel in the form of slabs over a wide range of sizes.

Yet another more specific object of the invention is to provide a submerged nozzle for continuous casting applications in the casting of austenitic or ferritic grades of stainless steel wherein during the initial filling of the mold metal is provided at a rate sufficient to reduce the filling time of the mold and yet not cause harmful flaring and splashing onto the mold walls and during subsequent casting operations, the metal flow pattern in the mold is such that the incoming and hottest metal initially flows to the surface to contact the mold flux so that there is rapid melting of the flux, heat extraction from the metal, and removal of nonmetallics entrained in the metal. The nonmetallics are removed by absorption in the molten flux or if insoluble, the flow provides for a more uniform distribution of the entrained material, such as titanium nitrides, over the entire cross-sectional area of the cast slab.

These objects are achieved in accordance with the invention by providing a nozzle comprising a tube having an upper end portion adapted for connection to a source of molten metal to be introduced to a continuous casting mold and a lower end that is closed. Adjacent the lower end there are two molten metal outlet ports of equal diameter and in opposed relation with each being axially inclined upwardly at an angle $\theta$ of 12° to 17°, preferably at an angle of about 15°. Four additional equal diameter molten metal outlet ports with the diameter of each being larger than the diameter of each of said two molten metal outlet ports are positioned adjacent said lower end of the nozzle in diametrically opposed pairs with each pair being nonradial at the included angle $\phi$ of 28° to 32°, preferably at an included angle of approximately 30°. These ports are also inclined upwardly at an angle $\theta$ of 12° to 17°, preferably at an angle of about 15°. Preferably all of the molten metal outlet ports are inclined upwardly at substantially the same angle. When used in the production of continuously cast slabs, or when a rectangular cross-sectional mold is used, the two metal outlet ports of equal diameter face one of the relatively longer mold walls and each pair of the additional larger outlet ports face one of the mold walls of relatively shorter length. Preferably, the pairs of relatively larger molten metal outlet ports are of elongated or generally elliptical cross section.

BRIEF DESCRIPTION OF THE DRAWINGS

FIG. 1 is an elevational view of one embodiment of a nozzle in accordance with the invention;

FIG. 2 is a sectional view of FIG. 1 taken along lines AA of FIG. 1;

FIG. 3 is a sectional view taken along lines BB of FIG. 1 and shown in combination with a rectangular casting mold;

FIG. 4 is a sectional view taken along lines CC of FIG. 3;

FIG. 5 is a detailed view of one of the metal outlet ports; and

FIG. 6 is a detailed view of one of the pairs of diametrically opposed outlet ports.

DETAILED DESCRIPTION OF THE PREFERRED EMBODIMENT

With reference to the drawings, there is shown in FIG. 1 thereof a nozzle in accordance with the invention designated generally as 10. The nozzle is of elongated tubular construction, having at an upper portion thereof a collar 12 which is adapted for connection in the well known manner to a source of molten metal (not shown). The opposite end of the nozzle 10 designated as 14 is closed. Adjacent the lower end 14 are two opposed metal outlet passages 16 and 16*a*. These passages are inclined upwardly at an angle $\theta$ of approximately 15°. There is also provided two pairs of diametrically opposed outlet passages 18 and 18*a*. These passages are of relatively larger size in cross section than passages 16 and 16*a* and are also inclined upwardly at an angle $\theta$ of approximately 15°. Each pair 18 and 18*a* of outlet ports or passages are oriented nonradially at an included angle $\phi$ of approximately 30°. Preferably, included angle $\phi$ is symmetrical about a first center line, and preferably each pair of ports are symmetrical with the other pair of ports about a second center line. The cross section of passages 16 and 18 are elongated or generally elliptical in the direction of the longitudinal axis of the nozzle 10.

In the operation of the nozzle in a continuous casting operation, as earlier described, the nozzle is positioned within a rectangular mold with the two molten metal outlet ports of equal diameter (16 and 16*a*) each facing one of the relatively longer mold walls 20 and each pair of the outlet ports of relatively larger cross section (18 and 18*a*) facing one of the mold walls of relatively shorter length 22. With this arrangement, the outlet ports (16 and 16*a*) that impinge at the slab or mold mid-width portion are of reduced size to limit the impingement of the stream of hot metal introduced to the mold at this area thereof. This avoids remelting of the solidified casting shell which may result in longitudinal surface cracks or in extreme cases to a breakout of molten metal through this solidified shell portion. The inclining of all of the outlet ports, both at the longer and narrower walls of the mold, reduces the molten metal impingement velocity on the mold walls to prevent vortex formation and thereby mold flux from being drawn down into the molten metal in the mold and entrapped in the solidified portion thereof. This was achieved by the increased cross-sectional area of the relatively larger-sized ports 18 and 18*a*, which was accomplished by the generally elliptical shape thereof to prevent weakening of the end portion of the nozzle in which these ports are located. Consequently, with the nozzle of the invention as shown in the drawings, during startup of the casting operation, the molten metal flows from the two pairs of larger-sized ports gently without flaring and splashing. The flow characteristics are uniform, smooth, and repeatable, which allows the mold to be filled at a highly controlled rate over that obtained with the use of conventional bifurcated nozzles. This, therefore, eliminated the need to use splash cans in the mold during startup. After the molten metal in the mold covers the nozzle ports, a quiescent metal surface is obtained to which application of mold powder may be made without concern for it being drawn down into the molten metal.

EXAMPLE I

Data was obtained for the casting of AISI Types 409 and 413 stainless steels using bifurcated nozzles and using a nozzle in accordance with the invention. The bifurcated nozzles had two molten metal outlet ports adjacent the lower closed end of the nozzle. The ports were diametrically opposed and each faced one of the mold walls of relatively shorter length. The bifurcated nozzles had ports of either 1.75 or 1.563 inches (4.445 or 3.970 cm) inclined upwardly at 20° or 2.0 inches (5.08 cm) inclined upwardly at 15°. The nozzle of the present invention, as shown in FIGS. 1–6, had two metal outlet ports of equal diameter of 0.375 inch (0.952 cm) and two pairs of diametrically opposed elliptical outlet ports of larger cross-sectional size. These ports were elliptical in the direction of the axis of nozzle. The elliptical ports had 0.5 inch (1.27 cm) radii on about 1.0 inch (2.54 cm) centers. The equal diameter ports were inclined upwardly at 15°. The two pairs of outlet ports were oriented nonradially at an included angle of 30° and were also inclined upwardly at about 15°. The two ports of equal diameter were positioned with each facing one of the relatively longer walls of the mold. Each pair of additional ports faced one of the walls of relatively shorter length. Each nozzle was made of graphitized alumina.

The improvement in "titanium streak quality" of these castings is shown in Table I for hot-rolled band coiled produced from continuously cast slabs of T409/413 steel.

TABLE I

| | Number of Heats (Percentage) | | | |
|---|---|---|---|---|
| Nozzle Type | Very Good | Good | Below Avg. | Poor |
| Bifurcated | 175 (78.1%) | 39 (17.4%) | 5 (2.2%) | 5 (2.2%) |
| Pres. Invention | | | | |
| Group A | 42 (89.36%) | 5 (10.64%) | 0 | 0 |
| Group B | 61 (76.25%) | 17 (21.25%) | 1 (1.25%) | 1 (1.25%) |

Notes:
Very Good - virtually no TiN streaks
Good - few or light TiN streaks
Below Average - marginal TiN streaks
Poor - scrap

EXAMPLE II

Using the same nozzles as set forth in Example I, the improvement in first slab quality is shown for T304 steel in hot-rolled band coil form in Table II.

TABLE II

| Nozzle Type | Number of Coils | Okay | Percentage Strip Ground |
|---|---|---|---|
| Bifurcated | 77 | 51.9% | 48.1%(1) |
| Pres. Invention | 124 | 79.1% | 20.9%(2) |

Notes:
(1)Strip Ground for metallurgical defects - laps and metallurgical slivers
(2)Strip Ground for laps only

EXAMPLE III

The first slab quality for 6 hot-rolled band coils of T409/413 was also determined for the nozzle of the present invention of Example I. As for all defects, 5 coils were very good and had no defects, only 1 coil had lap defects, and no coils had TiN streak defects. These coils were 100% free of TiN streak defects and were 83.3% free of laps.

Although preferred and alternative embodiments have been described, it will be apparent to one skilled in the art that changes can be made therein without departing from the scope of the invention.

What is claimed is:

1. A nozzle for introducing molten metal below the surface of a molten metal pool in a flow-through continuous casting mold, said nozzle comprising a tube having an upper end portion adapted for connection to a source of molten metal to be introduced to said continuous casting mold and a lower end that is closed, two molten metal outlet ports of equal diameter positioned adjacent said lower end of said nozzle and being in opposed relation and each being axially inclined upwardly at an angle of 12° to 17°, four additional equal cross section molten metal outlet ports with the cross-sectional size of each being larger than each of said two molten metal outlet ports of equal diameter, said additional ports being positioned adjacent said lower end of said nozzle in diametrically opposed pairs with each pair being nonradial at an included angle of 28° to 32° and inclined upwardly at an angle of 12° to 17°.

2. The nozzle of claim 1 wherein all said molten metal outlet ports are inclined upwardly at substantially the same angle.

3. The nozzle of claim 2 wherein said included angle of each pair is about 30°.

4. The nozzle of claim 3 wherein all said molten metal outlet ports are inclined upwardly at an angle of about 15°.

5. A nozzle for introducing molten metal below the surface of a molten metal pool in a flow-through continuous casting mold having a rectangular cross section defined by two opposed mold walls of relatively longer length and two opposed mold walls of relatively shorter length, said mold being adapted for slab casting, said nozzle comprising a tube having an upper end portion adapted for connection to a source of molten metal to be introduced to said continuous casting mold and a lower end that is closed, two molten metal outlet ports of equal diameter positioned adjacent said lower end of said nozzle and being in opposed relation and each being axially inclined upwardly at an angle of 12° to 17°, four additional equal cross section molten metal outlet ports with the cross-sectional size of each being larger than each of said molten metal outlet ports of equal diameter, said additional ports being positioned adjacent said lower end of said nozzle in diametrically opposed pairs with each pair being nonradial at an included angle of 28° to 32° and inclined upwardly at an angle of 12° to 17°, said nozzle being positioned within said rectangular mold with said two molten metal outlet ports of equal diameter each facing one of said relatively longer mold walls and each pair of said additional outlet ports facing one of said mold walls of relatively shorter length.

6. The nozzle of claim 5 wherein all said molten, metal outlet ports are inclined upwardly at substantially the same angle.

7. The nozzle of claim 6 wherein said included angle of each pair is about 30°.

8. The nozzle of claim 7 wherein all said molten metal outlet ports are inclined upwardly at an angle of about 15°.

9. The nozzle of claim 8 wherein said molten metal outlet ports are of elongated cross section.

* * * * *